US005920262A

United States Patent [19]

Copeland

[11] Patent Number: 5,920,262

[45] Date of Patent: Jul. 6, 1999

[54] OMNIDIRECTIONAL DEACTIVATOR FOR MAGNETIC LABELS OR TAGS OF EAS SYSTEMS

[75] Inventor: Richard L. Copeland, Boca Raton, Fla.

[73] Assignee: Sensormatic Electronics Corporation, Boca Raton, Fla.

[21] Appl. No.: 09/100,706

[22] Filed: Jun. 19, 1998

[51] Int. Cl.[6] ..... G08B 13/14

[52] U.S. Cl. ..... 340/572.3; 340/572.1; 340/572.4; 340/572.6; 340/551; 335/284

[58] Field of Search ..... 340/572, 551; 335/284; 446/129, 131, 132, 133; 235/493, 449, 450

[56] References Cited

U.S. PATENT DOCUMENTS

| | | | |
|---|---|---|---|
| 4,568,921 | 2/1986 | Pokalsky | 340/572 |
| 4,665,387 | 5/1987 | Cooper et al. | 340/572 |
| 4,684,930 | 8/1987 | Minasy et al. | 340/551 |
| 4,752,758 | 6/1988 | Heltemes | 335/284 |
| 4,935,724 | 6/1990 | Smith | 340/551 |
| 5,500,640 | 3/1996 | Zhou et al. | 340/572 |
| 5,594,420 | 1/1997 | Copeland et al. | 340/572 |

*Primary Examiner*—Jeffery A. Hofsass
*Assistant Examiner*—Toan N. Pham
*Attorney, Agent, or Firm*—Robin, Blecker & Daley

[57] ABSTRACT

An EAS tag or label deactivator having a central area and an edge area bordering the central area. The central area is formed from magnetic regions having alternating magnetic polarities arranged in a checkerboard pattern. The edge area is formed from a linear multipole magnet having magnetic regions of alternating polarity. The sides of the magnetic regions of the linear multipole magnetic are sized to be of lesser extent than the sides of the adjacent magnetic regions of the central area.

17 Claims, 3 Drawing Sheets

OMNIDIRECTIONAL DEACTIVATOR FOR MAGNETIC LABELS OR TAGS OF EAS SYSTEMS

BACKGROUND OF THE INVENTION

This invention relates to deactivators and, in particular, to deactivators for use in deactivating the magnetic tags or labels used in an electronic article surveillance ("EAS") system.

A type of magnetic tag or label used in an EAS system contains a control element formed of a magnetically semi-hard material. The state of the magnetic tag or label, as detected by an exit interrogation system, is determined in accordance with the magnetized state of the control element.

In some types of EAS systems, the tag or label is active when the control element is magnetized along a certain dimension. Thus, in these types of systems, the tag or label is deactivated by demagnetizing the control element or by substantially changing the magnetization state as by imprinting a multipole pattern. The tag or element can then be reactivated by magnetizing the element.

In order to deactivate these magnetic tags or labels, a variety of deactivators have been developed. One such deactivator is manufactured under the number ZK151 by the assignee of the present application and is shown in FIG. 1. This deactivator comprises a main linear multipole magnet 101 formed from alternating polarity magnetic strips 101A–101H. These strips are adjacently arranged along the width of the deactivator and extend along its length, with the alternating polarities being shown as the conventional north N and south S magnetic polarities.

Two subsidiary multipole magnets 102 and 103 are also provided in the deactivator. These subsidiary multipole magnets are situated along the lengths of opposing sides of the main multipole magnet 101 and have alternating polarity adjacently arranged magnetic elements 102A and 103A, respectively. The widths of these elements are equal to the widths of the elements 101A to 101H.

Using the aforesaid deactivator, successful deactivation of a tag or label depends on the orientation of the tag or label when moved across the deactivator. If a tag or label has its length along the width of the deactivator and is moved along its length, there is a high likelihood of successful deactivation. Also a tag with its length along the length of the deactivator, which is moved along the deactivator width and past its side will also have a high likelihood of deactivation. As the tag orientation and movement deviate from these two situations, successful deactivation becomes less likely. This is especially true for narrow tags or labels moved with their lengths along the length or width of the deactivator and whose widths are equal to or less than the multipole magnetic spacing.

Another type of deactivator which has less sensitivity to tag or label orientation is disclosed in U.S. Pat. No. 4,684,930 to Minasy, et al. The deactivator of the Minasy, et al. patent comprises two linear multipole magnets arranged in parallel planes. Each magnet has magnetic strips of alternating polarity arranged along the width of the magnet and extending along its length. These magnets are further arranged with their lengths orthogonal to each other and wrapped around a rotatable cylinder.

The aforesaid construction of the deactivator of the Minasy, et al. patent makes the deactivator less sensitive to tag or label orientation or movement direction. However, the need to use two multipole magnets and to situate them in orthogonal planes and on a roller, complicates the manufacturing of the deactivator.

Also, when similar strength magnet material is used for the two magnets, the surface field pattern is such that the top multipole magnet dominates and has the higher field levels. Matching the materials such that the surface field levels caused by the two magnets are equal is very difficult. Also, since the field falloff vs. height curves are nonlinear, matching the surface field levels would not be sufficient to cause the field levels at 1 mm or 2 mm above the surface to be matched. Therefore, performance suffers.

It is, therefore, an object of the present invention to provide an improved deactivator for magnetic EAS tags or labels which has decreased sensitivity to tag or label orientation.

It is a further object of the present invention to provide a deactivator of the aforementioned type which is of simplified construction and easy to use.

SUMMARY OF THE INVENTION

In accordance with the principles of the present invention, the above and other objectives are realized in a deactivator comprising a central area formed of a layer of magnetic material having magnetic regions arranged in a checkerboard pattern of alternating magnetic polarity, i.e., arranged so as to alternate in polarity both along the length and width of the central area. The deactivator further includes an edge area bordering the central area. The edge area is formed of a linear multipole magnet having magnetic regions of alternating magnetic polarity arranged along the border of the central area. The magnetic regions of the edge area are of extent so that one and at least a part of another of these regions abut against an adjacent region of the central area.

In the embodiment of the invention to be disclosed hereinafter, the central area is of rectangular configuration having a length greater than its width and the magnetic regions in the central area are of square configuration. The linear multipole magnet of the edge area comprises four separate linear multipole magnetic sections each bordering a side of the rectangular central area. The magnetic regions of each of these linear multipole magnets are rectangular and each region has its shorter side abutting a side of a magnetic region of the central area which is longer than such shorter side.

BRIEF DESCRIPTION OF THE DRAWINGS

The above and other features and aspects of the present invention will become more apparent upon reading the following detailed description in conjunction with the accompanying drawings in which.

DETAILED DESCRIPTION

Figure 1:
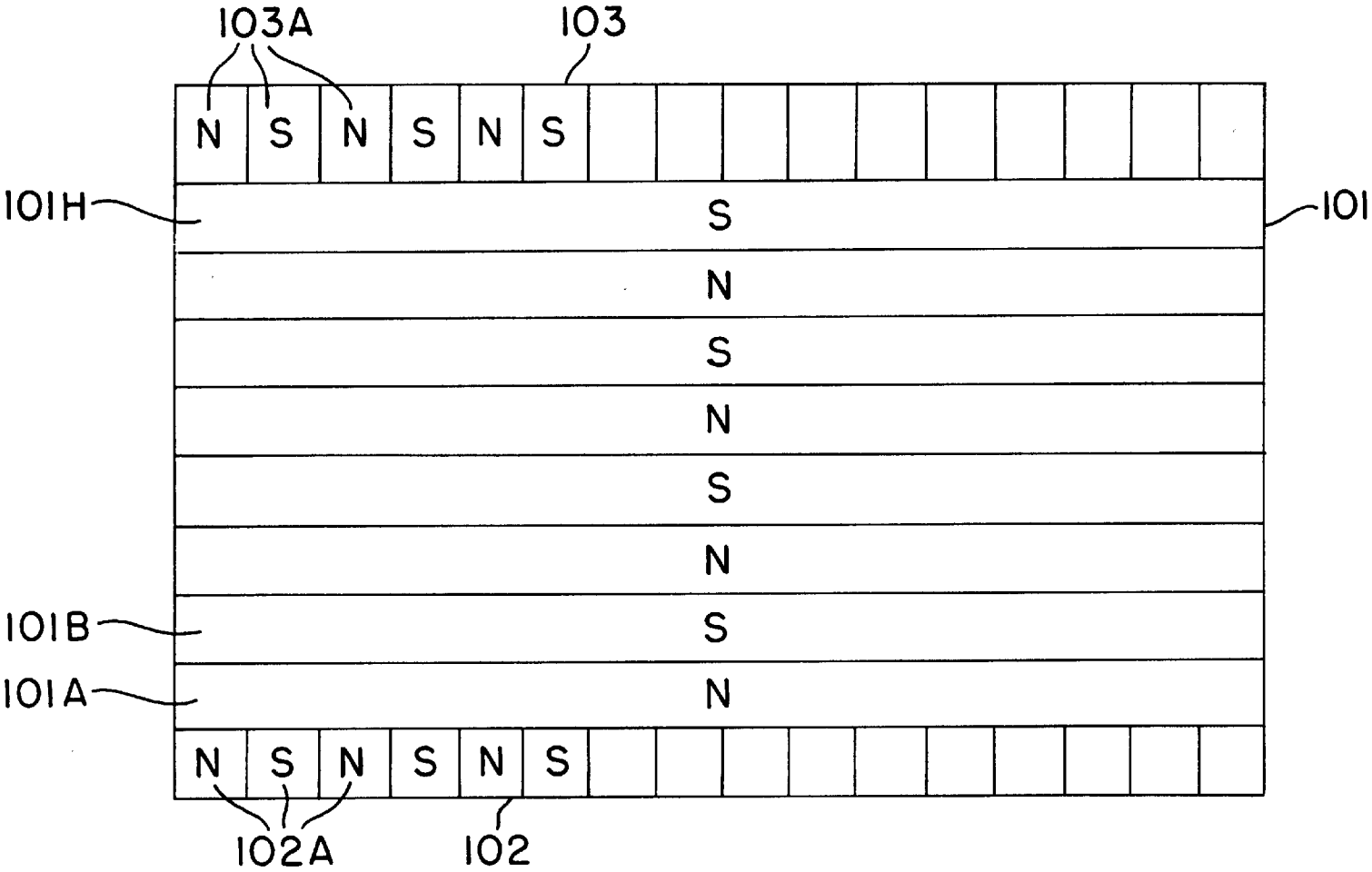
FIG. 1 (PRIOR ART)
FIG. 1 shows a prior art type deactivator.
Figure 2:
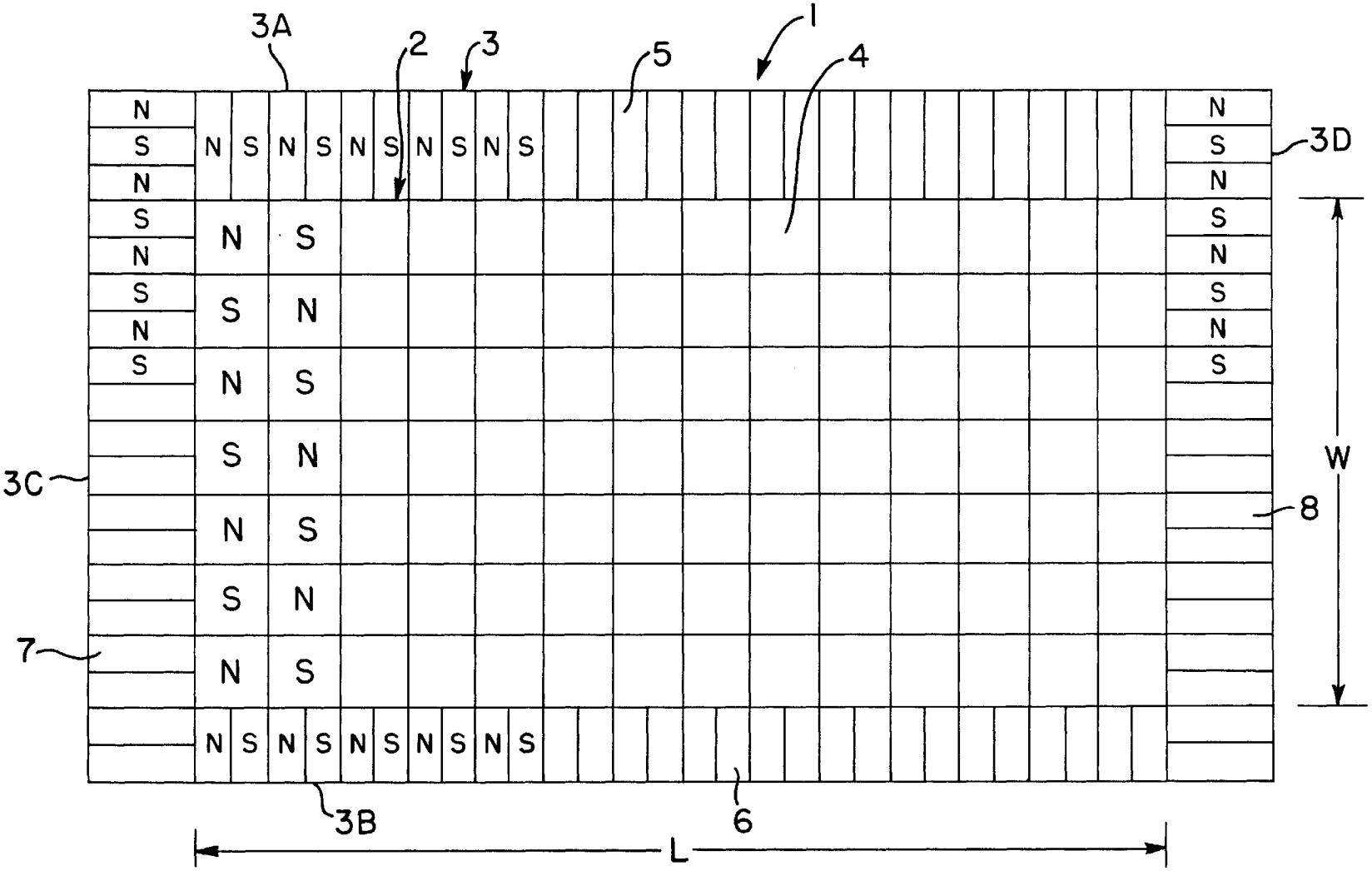
FIG. 2 shows a deactivator in accordance with the principles of the present invention.

FIG. 2 shows a deactivator 1 in accordance with the principles of the present invention. The deactivator 1 comprises a central area 2 bordered by a side area 3. The central area 2 is formed to have magnetic regions 4 both in the length L and width W directions of the area which alternate in magnetic polarity.

The alternate magnetic polarities of the regions 4 are indicated by the conventional north N and south S magnetic polarities. As can be seen, each N polarity region is followed by a S polarity region and each S polarity region is followed by a N polarity region in the length L and width W directions. The alternating polarity regions 4 in the central area 2 thus form a checkerboard pattern. This pattern results in a magnetic field above the surface of the area 2 which also alternates in direction in the length L and width W directions.

The side or edge area 3 of the deactivator 1 comprises four linear multipole magnets 3A–3D, each having magnetic regions which alternate in magnetic polarity along the border of the central area 2. Thus, the multipole magnet 3A comprises the alternating polarity N and S regions 5, the multipole magnet 3B comprises the alternating polarity N and S regions 6, the multipole magnet 3C comprises the alternating polarity N and S regions 7, and the multipole magnet 3D comprises the alternating polarity N and S regions 8. The side of each of the magnetic regions 5, 6, 7 and 8 abuts a side of a magnetic region 4 and is of an extent which is less than the extent of such side. Therefore, each magnetic region 4 is abutted by one and at least part of another region of one or more of the multipole magnets 5–8.

In the case shown, the central area 2 is of rectangular configuration with its length L greater than its width W. The magnetic regions 4 of the central area 2 are, in turn, square in shape, while the magnetic regions 5–8 are rectangular in shape and have their short sides abutting the longer sides of the regions 4.

With the deactivator 1 of the invention configured as aforesaid, an EAS tag or label can be deactivated regardless of the orientation and/or movement of the label or tag relative to the deactivator. Thus, the deactivator is omnidirectional in nature and its use is greatly simplified.

Moreover, the use of the edge area 3 with magnetic regions whose widths are less than that of the magnetic regions of the central area 2 allows for deactivation of narrow magnetic labels or tags, i.e., tags or labels whose semi-hard bias magnets are of a width less than that of the magnetic regions of the central area. These narrow tags or labels will thus be deactivated when swiped over the edge of the central area.

Fabrication of the deactivator 1 is also simplified since the central area 2 and edge area 3 can each be formed of a single layer of magnetic material. In particular, the central area 2 of the deactivator 1 can be formed from a single layer of a high-grade bonded ferrite material. A typical material might be Plastiform 1033 manufactured by Arnold Engineering Bonded Magnet Plant, Norfolk, Nebr. The overall size of the central area 2 might be 10.0 inches (25.4 cm) in length L and 3.5 inches (8.89 cm) in width W, with a thickness of 0.150 of an inch (0.381 cm). The latter would, therefore, be the thickness of the square magnetic regions 4 and a typical side dimension for each of these regions might be 0.25 of an inch (0.635 cm).

Each of the linear multipole magnetics 3A–3D can be made from a layer of fully loaded Neodymium Iron Boron (NdFeB) bonded magnetic material. A typical material is Plastiform 1202, also manufactured by Arnold Engineering. The thickness of the material might be 0.150 of an inch (0.381 cm) which would be the thickness of each of the magnetic regions 5–8. These regions can have a short side dimension, i.e., the dimension abutting the central area, of 0.175 of an inch (0.4445 cm).

Typically, the desired magnetization patterns can be formed in these materials by direct magnetization with carefully designed magnetizers or by using cut magnetic parts. Usually, a magnetic steel flux diverter plate is used on the bottom side of the material to enhance the surface magnetic field intensity.

As above-mentioned, the short side dimension of the magnetic regions 5–8 is shorter than the corresponding dimension of the abutting regions 4 of the central area so as to better deactivate narrow labels or tags swiped over the edge of the central area. This is due to the fact that the width dimension of 0.175 of an inch (0.4445 cm) for each of the magnetic regions 5–8 is less than the typical width dimension of 0.6 cm for the bias magnets used in such narrow tags or labels.

Because of the aforesaid smaller widths or pole spacings of the regions 5–8, however, the magnetic field resulting from the multipole magnets 3A–3D falls off faster than the magnetic field resulting from the central area. Hence, the material used for the multipole magnets is stronger magnetically than that used for the central area.

Figure 3:
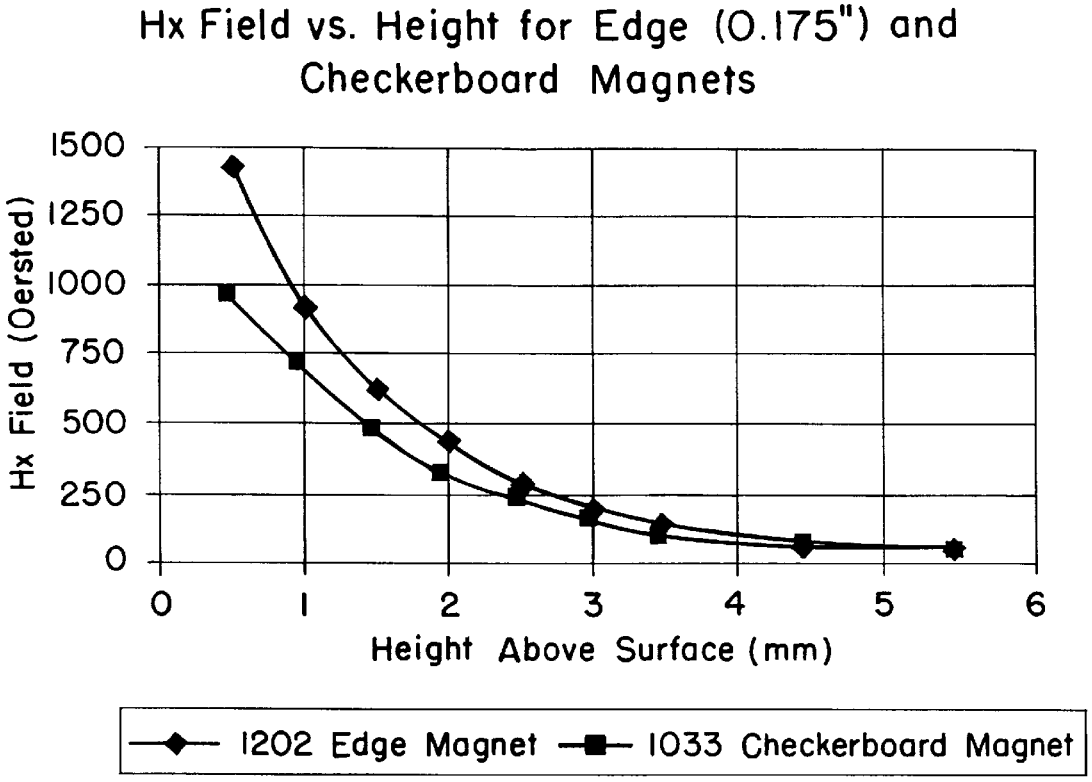
FIG. 3 shows a graph of the magnetic field versus distance for the deactivator of FIG. 2.

FIG. 3 illustrates the magnetic field Hx versus height for the deactivator 1 of the present invention. The flux both for the central area 2 and the edge area 3 is depicted. As can be seen, the maximum distance for deactivation is about 3 mm from the surface of the deactivator at which point both the central and edge areas have about the same field intensity (225 Oersted).

Figure 4:
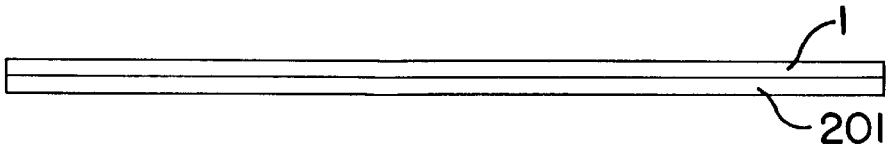
FIG. 4 shows the deactivator of FIG. 1 modified to include a flux diverter.

FIG. 4 shows the deactivator 1 used in combination with a magnetic steel plate 201 situated under the deactivator to form a composite deactivator unit. The plate 201 increases the field above the deactivator 1, thereby enhancing the deactivation operation. More particularly, the plate 201 acts as a flux diverter diverting the magnetic flux underneath the deactivator 1 upwardly into the desired deactivation zone adjacent the top surface of the deactivator.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claimed is:

1. A deactivator for use in deactivating magnetic EAS labels comprising:

a central area having magnetic regions of alternating magnetic polarity arranged in a checkerboard pattern; and an edge area bordering the central area formed of a multipole linear magnet having magnetic regions of alternating magnetic polarity, the extent of the magnetic regions of said edge area being such that one and at least a part of another of said magnetic regions of said edge area abut the same adjacent magnetic region of said central area.

2. A deactivator in accordance with claim 1 wherein:

said central area is formed of a single layer of magnetic material.

3. A deactivator in accordance with claim 1 wherein:

said central area comprises a high-grade bonded ferrite material;

and said edge area comprises a fully loaded Neodymium Iron Boron bonded magnetic material.

4. A deactivator in accordance with claim 1 further comprising:

a magnetic plate situated under said central and edge areas.

5. A deactivator in accordance with claim 4 wherein:

said magnetic plate is a steel plate.

6. A deactivator for use in deactivating magnetic EAS labels comprising:

a central area having magnetic regions of alternating magnetic polarity arranged in a checkerboard pattern, said magnetic regions of said central area being square; and an edge area bordering the central area formed of a multipole linear magnet having magnetic regions of alternating magnetic polarity, said magnetic regions of said multipole linear magnet being rectangular.

7. A deactivator in accordance with claim 6 wherein:

the shorter side of each of said magnetic regions of said multipole magnet abuts a side of a magnetic region of said central area and is shorter than that side of that magnetic region of the central area.

8. A deactivator in accordance with claim 7 wherein:

said shorter side of each of said magnetic regions of said linear multipole magnet is 0.175 of an inch;

and the side of each of said magnetic regions of said central area is 0.25 of an inch.

9. A deactivator in accordance with claim 8 wherein:

the thickness of the magnetic regions of said central area and of the magnetic regions of said linear multipole magnetic is 0.150 of an inch.

10. A deactivator for use in deactivating magnetic EAS labels comprising:

a central area having magnetic regions of alternating magnetic polarity arranged in a checkerboard pattern, said central area being rectangular in shape; and an edge area bordering the central area formed of a multipole linear magnet having magnetic regions of alternating magnetic polarity, said linear multipole magnet comprising first, second, third and fourth linear multipole magnetic sections each arranged along a side of the central area.

11. A deactivator in accordance with claim 10 wherein:

the central area is 10 inches in length and 3.5 inches in width.

12. A deactivator in accordance with claim 10 wherein:

said first and second linear multipole magnetic sections extend along opposing first and second sides of said central area and have a length equal to the length of said opposing sides;

and said third and fourth linear multipole magnetic sections extend along opposing third and fourth sides of said central area and along the sides of the terminal magnetic regions of the first and second linear multipole magnetic sections abutting the opposing first and second sides of the central area.

13. A deactivator in accordance with claim 10 wherein:

the magnetic regions of said central area are square;

and the magnetic regions of said multipole linear magnet are rectangular.

14. A deactivator in accordance with claim 13 wherein:

the shorter side of each of said magnetic regions of said multipole magnet abuts a side of a magnetic region of said central area and is shorter than that side of that magnetic region of the central area.

15. A deactivator in accordance with claim 14 wherein:

said shorter side of each of said magnetic regions of said linear multipole magnet is 0.175 of an inch;

and the side of each of said magnetic regions of said central area is 0.25 of an inch.

16. A deactivator in accordance with claim 15 wherein the thickness of the magnetic regions of said central area and of the magnetic regions of said linear multipole magnetic is 0.150 of an inch.

17. A deactivator in accordance with claim 16 wherein the central area is 10 inches in length and 3.5 inches in width.

* * * * *